US006444083B1

(12) United States Patent
Steger et al.

(10) Patent No.: US 6,444,083 B1
(45) Date of Patent: Sep. 3, 2002

(54) CORROSION RESISTANT COMPONENT OF SEMICONDUCTOR PROCESSING EQUIPMENT AND METHOD OF MANUFACTURING THEREOF

(75) Inventors: Robert Steger, Los Altos; Chris Chang, Sunnyville, both of CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/343,692

(22) Filed: Jun. 30, 1999

(51) Int. Cl.[7] ..... H01L 21/302; C23F 1/02; C23C 16/00

(52) U.S. Cl. ..... 156/345 V; 118/723 R; 118/715; 118/720; 427/446; 427/453; 216/75; 216/95; 216/96

(58) Field of Search ..... 118/723 R, 715, 118/720; 427/446, 453; 216/75, 95, 96; 156/345 V

(56) References Cited

U.S. PATENT DOCUMENTS

| | | | | |
|---|---|---|---|---|
| 4,340,462 A | | 7/1982 | Koch | 204/298 |
| 4,361,630 A | * | 11/1982 | Johnson, Sr. | 428/613 |
| 4,491,496 A | | 1/1985 | Laporte et al. | 156/345 |
| 4,673,468 A | | 6/1987 | Myers et al. | 204/24 |
| 4,948,458 A | | 8/1990 | Ogle | 156/643 |
| 5,116,430 A | * | 5/1992 | Hirai et al. | 148/518 |
| 5,200,232 A | | 4/1993 | Tappan et al. | 427/569 |
| 5,262,029 A | | 11/1993 | Erskine et al. | 204/298.15 |
| 5,294,462 A | * | 3/1994 | Kaiser et al. | 427/446 |
| 5,366,585 A | | 11/1994 | Robertson et al. | 156/643 |
| 5,522,932 A | | 6/1996 | Wong et al. | 118/715 |
| 5,641,375 A | | 6/1997 | Nitescu et al. | 156/345 |
| 5,680,013 A | | 10/1997 | Dornfest et al. | 315/111.21 |
| 5,723,187 A | * | 3/1998 | Popoola et al. | 427/453 |
| 5,725,907 A | * | 3/1998 | Ohmi et al. | 427/249 |
| 5,798,016 A | | 8/1998 | Oehrlein et al. | 156/345 |
| 5,820,723 A | | 10/1998 | Benjamin et al. | 156/345 |
| 5,838,529 A | | 11/1998 | Shufflebotham et al. | 361/234 |
| 5,863,376 A | | 1/1999 | Wicker et al. | 156/345 |
| 5,879,523 A | | 3/1999 | Wang et al. | 204/298.11 |
| 5,895,586 A | | 4/1999 | Kaji et al. | 219/121.43 |
| 6,093,453 A | * | 7/2000 | Ang | 427/438 |

FOREIGN PATENT DOCUMENTS

| | | | |
|---|---|---|---|
| EP | 0 446 079 A1 | | 9/1991 |
| EP | 0 737 759 A1 | | 10/1996 |
| GB | 2212172 A | | 7/1989 |
| JP | 62 170465 A | | 7/1987 |
| JP | 04 161308 A | | 6/1992 |
| JP | 05-063063 | * | 3/1993 |

OTHER PUBLICATIONS

"Elements of Materials Science and Engineering", Van Vlack; Addison–Wesley Publishing Co., Reading, MA;, pp. 59–60, © 1980.*

Metals Handbook, edited by H. Boyer and T. Gall, 5$^{th}$ Ed., American Society for Metals (1989), Section III, 29.16–29.19.

ASM Handbook, vol. 7, Power Metal Technologies and Applications, "Thermal Spray Forming of Materials" by Richard Knight and Ronald W. Smith, pp. 408–419 (1998).

Notification of Transmittal of the International Preliminary Examination Report, PCT/US00/40229, Dated Jun. 13, 2001, 8 pgs.

* cited by examiner

*Primary Examiner*—George Goudreau
(74) *Attorney, Agent, or Firm*—Burns, Doane, Swecker & Mathis, LLP

(57) ABSTRACT

A corrosion resistant component of semiconductor processing equipment such as a plasma chamber includes a metal surface such as aluminum or aluminum alloy, stainless steel, or refractory metal coated with a phosphorus nickel plating and an outer ceramic coating such as alumina, silicon carbide, silicon nitride, boron carbide or aluminum nitride. The phosphorus nickel plating can be deposited by electroless plating and the ceramic coating can be deposited by thermal spraying. To promote adhesion of the ceramic coating, the phosphorus nickel plating can be subjected to a surface roughening treatment prior to depositing the ceramic coating.

22 Claims, 1 Drawing Sheet

CORROSION RESISTANT COMPONENT OF SEMICONDUCTOR PROCESSING EQUIPMENT AND METHOD OF MANUFACTURING THEREOF

BACKGROUND OF THE INVENTION

1. Field of the Invention

The present invention relates to semiconductor processing equipment and a method of improving corrosion resistance of such components.

2. Description of the Related Art

In the field of semiconductor processing, vacuum processing chambers are generally used for etching and chemical vapor deposition (CVD) of materials on substrates by supplying an etching or deposition gas to the vacuum chamber and application of an RF field to the gas to energize the gas into a plasma state. Examples of parallel plate, transformer coupled plasma (TCP™) which is also called inductively coupled plasma (ICP), and electron-cyclotron resonance (ECR) reactors and components thereof are disclosed in commonly owned U.S. Pat. Nos. 4,340,462; 4,948,458; 5,200,232 and 5,820,723. Because of the corrosive nature of the plasma environment in such reactors and the requirement for minimizing particle and/or heavy metal contamination, it is highly desirable for the components of such equipment to exhibit high corrosion resistance.

During processing of semiconductor substrates, the substrates are typically held in place within the vacuum chamber by substrate holders such as mechanical clamps and electrostatic clamps (ESC). Examples of such clamping systems and components thereof can be found in commonly owned U.S. Pat. Nos. 5,262,029 and 5,838,529. Process gas can be supplied to the chamber in various ways such as by gas nozzles, gas rings, gas distribution plates, etc. An example of a temperature controlled gas distribution plate for an inductively coupled plasma reactor and components thereof can be found in commonly owned U.S. Pat. No. 5,863,376. In addition to the plasma chamber equipment, other equipment used in processing semiconductor substrates include transport mechanisms, gas supply systems, liners, lift mechanisms, load locks, door mechanisms, robotic arms, fasteners, and the like. The components of such equipment are subject to a variety of corrosive conditions associated with semiconductor processing. Further, in view of the high purity requirements for processing semiconductor substrates such as silicon wafers and dielectric materials such as the glass substrates used for flat panel displays, components having improved corrosion resistance are highly desirable in such environments.

Aluminum and aluminum alloys are commonly used for walls, electrodes, substrate supports, fasteners and other components of plasma reactors. In order to prevent corrosion of the such metal components, various techniques have been proposed for coating the aluminum surface with various coatings. For instance, U.S. Pat. No. 5,641,375 discloses that aluminum chamber walls have been anodized to reduce plasma erosion and wear of the walls. The '375 patent states that eventually the anodized layer is sputtered or etched off and the chamber must be replaced. U.S. Pat. No. 5,895,586 states that a technique for forming a corrosion resistant film of $Al_2O_3$, AlC, TiN, TiC, AlN or the like on aluminum material can be found in Japanese Application Laid-Open No. 62-103379.

U.S. Pat. No. 5,680,013 states that a technique for flame spraying $Al_2O_3$ on metal surfaces of an etching chamber is disclosed in U.S. Pat. No. 4,491,496. The '013 patent states that the differences in thermal expansion coefficients between aluminum and ceramic coatings such as aluminum oxide leads to cracking of the coatings due to thermal cycling and eventual failure of the coatings in corrosive environments. In order to protect the chamber walls, U.S. Pat. Nos. 5,366,585; 5,798,016; and 5,885,356 propose liner arrangements. For instance, the '016 patent discloses a liner of ceramics, aluminum, steel and/or quartz with aluminum being preferred for its ease of machinability and having a coating of aluminum oxide, $Sc_2O_3$ or $Y_2O_3$, with $Al_2O_3$ being preferred for coating aluminum to provide protection of the aluminum from plasma. The '585 patent discloses a free standing ceramic liner having a thickness of at least 0.005 inches and machined from solid alumina. The '585 patent also mentions use of ceramic layers which are deposited without consuming the underlying aluminum can be provided by flame sprayed or plasma sprayed aluminum oxide. The '356 patent discloses a ceramic liner of alumina and a ceramic shield of aluminum nitride for the wafer pedestal. U.S. Pat. No. 5,885,356 discloses ceramic liner materials for use in CVD chambers.

Various coatings have been proposed for metal components of semiconductor processing equipment. For instance, U.S. Pat. No. 5,879,523 discloses a sputtering chamber wherein a thermally sprayed coating of $Al_2O_3$ is applied to a metal such as stainless steel or aluminum with an optional $NiAl_x$ bond coating therebetween. U.S. Pat. Nos. 5,522,932 and 5,891,53 disclose a rhodium coating for metal components of an apparatus used for plasma processing of substrates with an optional nickel coating therebetween. U.S. Pat. No. 5,680,013 discloses non-bonded ceramic protection for metal surfaces in a plasma processing chamber, the preferred ceramic material being sintered AlN with less preferred materials including aluminum oxide, magnesium fluoride, and magnesium oxide. U.S. Pat. No. 5,904,778 discloses a SiC CVD coating on free standing SiC for use as a chamber wall, chamber roof, or collar around the wafer.

With regard to plasma reactor components such as showerhead gas distribution systems, various proposals have been made with respect to the materials of the showerheads. For instance, commonly owned U.S. Pat. No. 5,569,356 discloses a showerhead of silicon, graphite, or silicon carbide. U.S. Pat. No. 5,494,713 discloses forming an alumite film on an aluminum electrode and a silicon coating film such as silicon oxide or silicon nitride over the alumite film. The '713 patent states that the thickness of the silicon coating film should be 10 $\mu$m or less, preferably about 5 $\mu$m, since the aluminum coating film, the alumite coating film and the silicon coating film have different coefficients of linear expansion and cracks are easily generated when the thickness of the silicon coating film is too thick. A thickness below 5 $\mu$m, however, is stated to be unfavorable since the protection of the aluminum substrate is insufficient. U.S. Pat. No. 4,534,516 discloses an upper showerhead electrode of stainless steel, aluminum, copper or the like. U.S. Pat. No. 4,612,077 discloses a showerhead electrode of magnesium. U.S. Pat. No. 5,888,907 discloses a showerhead electrode of amorphous carbon, SiC or Al. U.S. Pat. Nos. 5,006,220 and 5,022,979 disclose a showerhead electrode either made entirely of SiC or a base of carbon coated with SiC deposited by CVD to provide a surface layer of highly pure SiC.

In view of the need for high purity and corrosion resistance for components of semiconductor processing equipment, there is a need in the art for improvements in materials and/or coatings used for such components. Moreover, with regard to the chamber materials, any materials which can increase the service life of a plasma reactor chamber and thus reduce the down time of the apparatus, would be beneficial in reducing the cost of processing the semiconductor wafers.

SUMMARY OF THE INVENTION

According to a first aspect of the invention a process for providing a corrosion resistant coating on a metal surface of a semiconductor processing equipment component is provided. The process includes: (a) depositing a phosphorus nickel plating on a metal surface of the component; and (b) depositing a ceramic coating on the phosphorus nickel plating so as to form an outer corrosion resistant surface. The metal surface can be anodized or unanodized aluminum, stainless steel, a refractory metal such as molybdenum or other metal or alloy used in plasma chambers. The ceramic coating can be alumina, SiC, AlN, $Si_3N_4$, BC or other plasma compatible ceramic material.

According to a second aspect of the invention, a metal component is provided. The component includes: (a) a metal surface; (b) a phosphorus nickel plating on the metal surface; and (c) a ceramic coating on the nickel plating, wherein the alumina coating forms an outer corrosion resistant surface.

BRIEF DESCRIPTION OF THE DRAWINGS

The objects and advantages of the invention will become apparent from the following detailed description of the preferred embodiments thereof in connection with the accompanying drawing, in which.

DETAILED DESCRIPTION OF THE PREFERRED EMBODIMENTS OF THE INVENTION

The invention provides an effective way to provide corrosion resistance to metal surfaces of components of semiconductor processing apparatus such as parts of a plasma processing reactor chamber. Such components include chamber walls, substrate supports, gas distribution systems including showerheads, baffles, rings, nozzles, etc., fasteners, heating elements, plasma screens, liners, transport module components, such as robotic arms, fasteners, inner and outer chamber walls, etc., and the like.

Although the invention is applicable to any type of component having a metal surface, for ease of illustration, the invention will be described in more detail with reference to the apparatus described in U.S. Pat. No. 5,820,723 which is incorporated herein by reference in its entirety.

Figure 1:
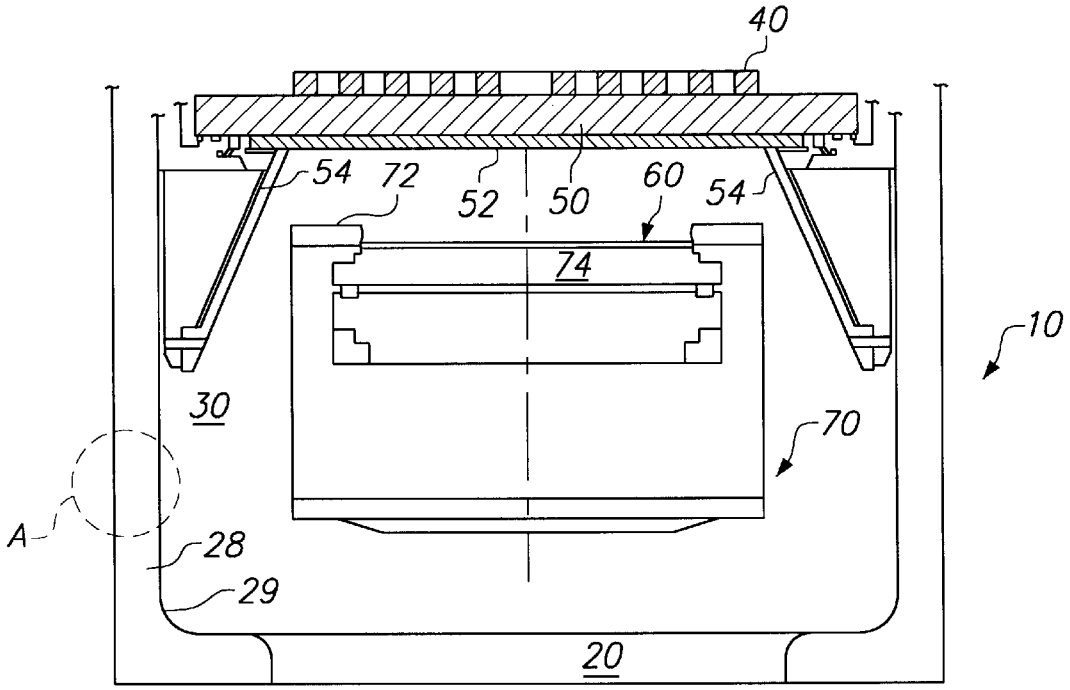
FIG. 1 is a schematic cross-sectional view of a plasma reactor chamber having a component coated with a corrosion resistant coating in accordance with the present invention.

FIG. 1 illustrates a vacuum processing reactor chamber 10 that includes a substrate holder 70 providing an electrostatic clamping force to a substrate 60 as well as providing an RF bias to the substrate while it is He backcooled. A focus ring 72 confines plasma in an area above the substrate. A source of energy for maintaining a high density (e.g., $10^{11}$–$10^{12}$ ions/cm$^3$) plasma in the chamber such as an antenna 40 powered by a suitable RF source to provide a high density plasma is disposed at the top of reactor chamber 10. The chamber includes suitable vacuum pumping apparatus for maintaining the interior 30 of the chamber at a desired pressure (e.g., below 50 mTorr, typically 1–20 mTorr) by evacuating the chamber through the centrally located vacuum port 20 at the bottom of the chamber.

A substantially planar dielectric window 50 of uniform thickness provided between the antenna 40 and the interior of the processing chamber 10 forms the vacuum wall at the top of the processing chamber 10. A gas distribution plate 52 is provided beneath window 20 and includes openings such as circular holes for delivering process gas from a gas supply to the chamber 10. A conical liner 54 extends from the gas distribution plate and surrounds the substrate holder 70.

In operation, a semiconductor substrate such as a silicon wafer 60 is positioned on the substrate holder 70 and is typically held in place by an electrostatic clamp 74 while He backcooling is employed. Process gas is then supplied to the vacuum processing chamber 10 by passing the process gas through a gap between the window 50 and the gas distribution plate 52. Suitable gas distribution plate arrangements (i.e., showerhead) arrangements are disclosed in commonly owned U.S. Pat. Nos. 5,824,605; 6,048,798; and 5,863,376, the disclosures of which are hereby incorporated by reference. For instance, while the window and gas distribution plate arrangement in FIG. 1 are planar and of uniform thickness, non-planar and/or non-uniform thickness geometries can be used for the window and/or gas distribution plate. A high density plasma is ignited in the space between the substrate and the window by supplying suitable RF power to the antenna 40.

Figure 2:
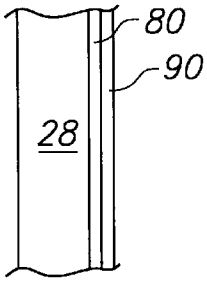
FIG. 2 shows details of the corrosion resistant coating in detail A of FIG. 1.

Chamber walls 28 such as anodized or unanodized aluminum walls and metal components such as the substrate holder 70, fasteners 56, liners 54, etc., that are exposed to plasma and show signs of corrosion are candidates for coating according to the invention, thus avoiding the need to mask them during operation of the plasma chamber. Examples of metals and/or alloys that may be coated include anodized or unanodized aluminum and alloys thereof, stainless steel, refractory metals such as W and Mo and alloys thereof, copper and alloys thereof, etc. In a preferred embodiment, the component to be coated is a chamber wall 28 having an anodized or unanodized aluminum surface 29. The coating according to the invention permits use of aluminum alloys without regard as to its composition (thus allowing use of more economical aluminum alloys in addition to highly pure aluminum), grain structure or surface conditions. In the following discussion, an example of a component to be coated is an aluminum chamber wall 28 having a phosphorus nickel coating 80 and a ceramic coating 90, as illustrated in FIG. 2.

According to the invention, a phosphorus nickel layer 80 is coated on the aluminum sidewall 28 by a conventional technique, including for example plating such as electroless and electroplating, sputtering, immersion coating or chemical vapor deposition. Electroless plating is a preferred method of providing the P—Ni coating, allowing intricate interior surfaces of the chamber or other chamber component such as gas passages in gas supply components to be plated without the use of an electric current. An example of a technique for electroless plating of a P—Ni alloy is disclosed in U.S. Pat. No. 4,636,255, the disclosure of which is hereby incorporated by reference. Also, conventional electroless plating processes are disclosed in *Metals Handbook*, edited by H. Boyer and T. Gall, 5$^{nd}$ Ed., American Society For Metals (1989).

In order to ensure good adhesion of the plated material, the surface of the aluminum substrate 28 is preferably thoroughly cleaned to remove surface material such as oxides or grease prior to plating. A preferred nickel alloy plating includes P in an amount of about 9 to about 12 weight percent and more preferably about 10 to about 12 weight percent.

The P—Ni coating 80 is sufficiently thick to adhere to the substrate and to further allow it to be processed prior to forming a ceramic layer 90 such as alumina, SiC, $Si_3N_4$, BC, AlN, etc. on the surface of the nickel. The P—Ni coating 80 can have any suitable thickness such as a thickness of at least about 0.002 inches, preferably from about 0.002 to about 0.010 inches more preferably between 0.002 and 0.004 inches.

After depositing the P—Ni coating 80 onto aluminum substrate 28, the plating can be blasted or roughened by any suitable technique, and then overcoated with a ceramic material. The ceramic material is preferably thermally sprayed onto the phosphorus nickel coating 80. The thus roughened layer 80 provides a particularly good bond with the molten ceramic particles. As the ceramic coating cools, it imparts a high mechanical compression strength to the coating 80 and minimizes formation of fissures in the coating 90. The ceramic coating 90 can comprise any desired ceramic material or combination of materials such as $Al_2O_3$, SiC, $Si_3N_4$, BC, AlN, $TiO_2$, etc.

The ceramic coating may be applied by other deposition techniques, such as chemical vapor deposition or RF sputtering. The preferred coating method is via thermal spraying in which ceramic powder is melted and incorporated in a gas stream directed at the component being spray coated. An advantage of thermal spraying techniques is that the metal body is coated only on the sides facing the thermal spray gun, and masking can be used to protect other areas. Conventional thermal spraying techniques, including plasma spraying are addressed in *The Science and Engineering of Thermal Spray Coating* by Pawlowski (John Wiley, 1995).

The ceramic layer 90 in the preferred embodiment is deposited by plasma spraying alumina onto the P—Ni layer 80 to a suitable thickness such as in the range of about 0.005 to about 0.040 inches, preferably 0.010 to 0.015 inches thick. The thickness of the alumina layer can be selected to be compatible with the plasma environment to be encountered in the reactor (e.g., etching, CVD, etc.). This layer of alumina 90 may be coated on all or part of the reactor chamber and components as discussed above. It is preferred that it be placed on the regions that may or may not be exposed to the plasma environment such as parts in direct contact with the plasma or parts behind chamber components such as liners, etc., to prevent nickel and/or aluminum contamination of the semiconductor substrates processed in the reactor chamber. Thereby, according to one advantage of the present invention, unsatisfactory etching or undesirable formation of pinholes in deposited films is reduced by suppressing occurrence of dust by corrosion.

While the invention has been described in detail with reference to specific embodiments thereof, it will be apparent to those skilled in the art that various chances and modifications can be made, and equivalents employed, without departing from the scope of the appended claims.

What is claimed is:

1. A process for coating a metal surface of a component of semiconductor processing equipment, the processing comprising:

(a) depositing a phosphorus nickel plating on a metal surface of a component of semiconductor processing equipment;

(b) depositing a ceramic coating on said phosphorus nickel plating, wherein said ceramic coating forms an outermost surface, wherein the ceramic coating is alumina and the metal surface is anodized or unanodized aluminum or an aluminum alloy.

2. The process for coating according to claim 1, wherein said phosphorus nickel plating is deposited by electroless plating.

3. The process for coating according to claim 1, wherein said component comprises a plasma chamber sidewall and said phosphorus nickel plating is deposited over an exposed inner surface of said sidewall.

4. The process for coating according to claim 1, wherein said phosphorous nickel plating includes about 9 to about 12 weight percent phosphorous.

5. The process for coating according to claim 1, wherein said phosphorus nickel plating is deposited to a thickness ranging from about 0.002 to about 0.004 inches.

6. The process for coating according to claim 1, further comprising subjecting said phosphorus nickel plating to a surface roughening treatment prior to depositing said ceramic coating, said ceramic coating being deposited on the roughened phosphorus nickel plating by plasma spraying said ceramic coating onto said phosphorus nickel plating to overcoat all or portions of said phosphorus nickel plating.

7. The process for coating according to claim 1, wherein said ceramic coating is deposited to a thickness ranging from about 0.005 to about 0.040 inches.

8. A component of semiconductor processing equipment comprising:

(a) a metal surface;

(b) a phosphorus nickel plating on said metal surface; and (c) a ceramic coating on said phosphorus nickel plating wherein said ceramic coating forms an outermost surface, wherein the ceramic coating is alumina and the metal surface is anodized or unanodized aluminum or an aluminum alloy.

9. The component according to claim 8, wherein said phosphorous nickel plating contains about 9 to about 12 weight percent of phosphorous.

10. The component according to claim 8, wherein said phosphorus nickel plating has a thickness ranging from about 0.002 to about 0.004 inches.

11. The component according to claim 8, wherein said ceramic coating is a plasma sprayed alumina coating having a thickness in a range from about 0.005 to 0.030 inches.

12. The component according to claim 8, wherein said component is a plasma chamber wall.

13. The component according to claim 8, wherein said ceramic coating is fissure resistant.

14. The component according to claim 8, wherein the phosphorus nickel plating includes a roughened surface in contact with the ceramic coating and the ceramic coating is a thermally sprayed coating.

15. A method of processing a semiconductor substrate in a plasma chamber containing the component of claim 8, the method comprising contacting an exposed surface of the semiconductor substrate with plasma.

16. A process for coating a metal surface of a component of semiconductor processing equipment, the processing comprising:

(a) depositing a phosphorus nickel plating on a metal surface of a component of semiconductor processing equipment;

(b) depositing a ceramic coating on said phosphorus nickel plating, wherein said ceramic coating forms an outermost surface, wherein said component comprises a plasma chamber sidewall, said phosphorus nickel plating is deposited over an exposed inner surface of said sidewall and said ceramic coating comprises $Al_2O_3$, SiC, $Si_3N_4$, BC or AlN.

17. A process for coating a metal surface of a component of semiconductor processing equipment, the processing comprising:

(a) depositing a phosphorus nickel plating on a metal surface of a component of semiconductor processing equipment;

(b) depositing a ceramic coating on said phosphorus nickel plating, wherein said ceramic coating forms an outermost surface, wherein said component comprises a plasma chamber sidewall, said phosphorus nickel plating is deposited over an exposed inner surface of said sidewall; and subjecting said phosphorus nickel plating to a surface roughening treatment prior to depositing said ceramic coating, said ceramic coating being deposited on the roughened phosphorus nickel plating by plasma spraying said ceramic coating onto said phosphorus nickel plating to overcoat all or portions of said phosphorus nickel plating.

18. A component of semiconductor processing equipment comprising:

(a) a metal surface;

(b) a phosphorus nickel plating on said metal surface; and (c) a ceramic coating on said phosphorus nickel plating wherein said ceramic coating forms an outermost surface, said ceramic coating is a plasma sprayed alumina coating having a thickness in a range from about 0.005 to 0.030 inches and said component is a plasma chamber wall.

19. A component of semiconductor processing equipment comprising:

(a) a metal surface;

(b) a phosphorus nickel plating on said metal surface; and (c) a ceramic coating on said phosphorus nickel plating wherein said ceramic coating forms an outermost surface, said ceramic is $Al_2O_3$, SiC, $Si_3N_4$, BC or AlN and said component is a plasma chamber wall.

20. A method of processing a semiconductor substrate in a plasma chamber containing the component of claim 18, the method comprising contacting an exposed surface of the semiconductor substrate with plasma.

21. A method of processing a semiconductor substrate in a plasma chamber containing the component of claim 19, the method comprising contacting an exposed surface of the semiconductor substrate with plasma.

22. A method of processing a semiconductor substrate in a plasma chamber containing a component, the component comprising:

(a) a metal surface;

(b) a phosphorus nickel plating on the metal surface; and (c) a thermally sprayed ceramic coating on the phosphorus nickel plating, the ceramic coating forming an outermost surface, the ceramic is $Al_2O_3$, SiC, $Si_3N_4$, BC or AlN, the phosphorus nickel plating includes a roughened surface in contact with the ceramic coating;

wherein the method comprises contacting an exposed surface of the semiconductor substrate with plasma.

* * * * *